United States Patent [19]

Keller

[11] 3,953,351

[45] Apr. 27, 1976

[54] LIQUID LAUNDRY DETERGENT

[75] Inventor: Arnold Arie Keller, Maartensdijk, Netherlands

[73] Assignee: Lever Brothers Company, New York, N.Y.

[22] Filed: Mar. 8, 1974

[21] Appl. No.: 449,411

[30] Foreign Application Priority Data

Mar. 15, 1973 United Kingdom..... 12512/73

[52] U.S. Cl...... 252/132; 252/DIG. 1; 252/DIG. 14; 252/142

[51] Int. Cl.[2]..... C11D 9/22

[58] Field of Search..... 252/142, 132, DIG. 1, 252/DIG. 14

[56] References Cited

UNITED STATES PATENTS

| | | | |
|---|---|---|---|
| 2,740,760 | 4/1956 | Pilch | 252/132 |
| 2,913,416 | 11/1959 | Fineman et al. | 252/DIG. 14 |
| 3,069,360 | 12/1962 | Manrowich | 252/DIG. 1 |
| 3,156,655 | 11/1964 | Bright | 252/DIG. 1 |
| 3,630,929 | 12/1971 | VanDijr | 252/132 X |
| 3,814,692 | 6/1974 | Mostow | 252/DIG. 1 |

*Primary Examiner*—Mayer Weinblatt
*Attorney, Agent, or Firm*—Lever Brothers Company

[57] ABSTRACT

A stable, liquid laundry detergent comprises a liquid nonionic detergent, a low-melting fatty acid and optionally water.

3 Claims, No Drawings

LIQUID LAUNDRY DETERGENT

The invention relates to liquid laundry detergents. More particularly the invention relates to liquid laundry detergents which can be suitably used for preparing stock-solutions for laundering.

Laundry institutions generally use large quantities of hard soap in powder or flake form in washing processes. From these soap powders and the usual alkalies (alkaline builders) separate stock-solutions are made which are transported and dosed into the washing machines in the required proportions. Normally the stock-solutions made from hard soaps are compounded to a concentration of approximately 10% by weight by means of live steam and kept at elevated temperatures to prevent them from gelling and solidifying.

The present invention provides an improved laundry detergent in a stable liquid form, which can be easily poured into and mixed with cold water to form stable stock-solutions, without requiring heating. It is obvious that such a detergent would give an enormous saving to the user in labour and energy consumption. Furthermore blowing through of the soap pipelines, as is normally required with stock-solutions from hard soaps at the end of each day is no longer necessary, due to the non-gelling properties of the stock-solution according to the invention.

Stock-solutions prepared from a liquid product according to the invention are not only stable on standing at ambient temperatures, but they also show an improved detergency action as compared with hard soap stock-solutions, allowing a reduced dosage for comparable results.

The liquid detergent according to the invention comprises about 5–80% by weight of a liquid nonionic surface-active agent, about 95–20% by weight of a low melting fatty acid and from 0 – about 20% by weight of water. If desired, the fatty acid may be present in a partially neutralised form using an alkali which produces a soluble soap. Suitable alkalies are for example sodium, potassium or ammonium hydroxide, and ethanolamine. Though not absolutely necessary, other adjuvants in minor amounts, such as optical bleaches, soil suspending agents, anti-oxidants etc., may be incorporated if desired.

Generally it is not advisable to apply a neutralisation degree of more than 40%, since the product would then become too viscous or even pasty, with consequent handling difficulties. Preferably the fatty acid in the composition is neutralised to a degree of about 5–35%, to obtain a product having a pH within the range of 4–8.

It should be understood that a slightly acid product is preferred to conventional alkaline soap products, since an acid product gives a better overall washing effect in laundry operations where the detergent product is used in the cold pre-wash stage prior to heating the washing liquor on addition of the alkaline builders.

The nonionic surface-active agents which can be suitably used in the present invention include any of the conventional types of water-soluble nonionic detergents which are liquid at ambient temperature, i.e. those having a melting/pour point up to about 25°C, preferably up to 20°C. These nonionic detergents are generally formed by condensing a polyalkylene oxide group, particularly a polyethylene oxide group to a lipophilic molecule derived from a wide variety of chemical classes including fatty acids, esters, alcohols, thioalcohols, amines, amides and alkylphenols. Another class of nonionic surface-active agents comprises blockpolymers obtained by condensing ethylene oxide on a polyoxypropylene base. Other types of nonionic surfactants are described in the book "Nonionic Surfactants" by Martin J. Schick, Surfactant Science Series, Volume I (1967) issued by Marcel Dekker Inc., New York.

Examples of such suitable nonionic surface-active agents are liquid ethoxylated alkyl phenols such as nonyl or octylphenol condensed with 8–12 moles ethylene oxide; liquid ethoxylated alcohols, such as lauryl alcohol condensed with 6–12 moles ethylene oxide, $C_{13}$-$C_{15}$-secondary alcohol condensed with 7–10 moles ethylene oxide; liquid ethoxylated fatty acids; liquid polyoxyethylene esters; and liquid polyethylene oxide - polyoxypropylene condensates.

As suitable fatty acids can be named saturated or unsaturated $C_8$-$C_{22}$ fatty acids, either as a single fatty acid or as a mixture, including synthetic fatty acids which are liquid under normal ambient conditions, i.e. those having a melting/pour point up to about 25°C, such as oleic acid, linoleic acid, fatty acids derived from nut oils or rapeseed oil, tall oil fatty acids, and mixtures thereof.

In preparing the liquid detergent according to the invention, the essential components can be easily mixed to form a homogeneous mixture. Water or an alkali solution may be added as desired for partial neutralisation of the fatty acid.

EXAMPLES I–III 45 grams of a liquid nonionic surface-active agent (Tergitol 15-S-9*) ex Union Carbide) were mixed with 45 grams of a fatty acid (Olein 7503**) ex Unilever-Emery N.V.) in a beaker. To this mixture were added with slow stirring 10 grams of a 4N NaOH-solution, prepared from 6.8 grams of water and 3.2 grams 50% NaOH solution to give a 25% neutralisation of the fatty acid.

The resulting mixture, consisting of the following composition, was a homogeneous, transparent liquid.

| Composition I | % by weight |
|---|---|
| *)Tergitol-15-S-9 ($C_{11-15}$ secondary alcohols 9 ethylene oxide | 45 |
| **)Olein 7503 (oleic acid) | 45 |
| Water | 8.4 |
| NaOH | 1.6 |

On prolonged storage at room temperature the liquid product had remained unchanged.

A 10% stock-solution was prepared by dissolving the product in water at room temperature. The stock-solution was stored for 2 days and showed no separation.

A similar Composition II was prepared in the same manner but using tall oil fatty acid instead of olein 7503. The product showed the same stability and ease to prepare stock-solutions as Composition I.

A third liquid Composition III was prepared having the following formula:

| Composition III | % by weight |
|---|---|
| Tergitol 15-S-9 | 27 |
| Oleic acid | 60 |

-continued

| Composition III | % by weight |
|---|---|
| Water | 10.9 |
| NaOH | 2.1 |

EXAMPLE IV

Washing tests were carried out with an industrial laundry machine using 10% stock-solutions of Composition I and Composition III of Examples I–III, in combination with "Virix", a commercial alkaline builder mixture comprising essentially $Na_2CO_3$, sodium metasilicate and sodium triphosphate.

Various standard soiled and stained test fabrics were included in these tests to establish detergency and stain removal.

The results obtained as mean values from 5 washings are shown in the following table. A normal hard soap stock-solution was used at the prescribed dosage for comparison.

| Dosages: | |
|---|---|
| Composition I | 2.3 g/kg wash load |
| Composition III | 2.3 g/kg wash load |
| Hard soap (85% fatty acid) content) | 5.9 g/kg wash load |
| Builder in main liquor | 11.7 g/kg wash load |

TABLE

| Detergent system | Detergency % | | Stain removal % | | | | Foam height |
|---|---|---|---|---|---|---|---|
| | Standard soil | | | | | | |
| | −casein | +casein | blood | cocoa | EMPA 116 | tea | cm |
| I/ builder | 78 | 82 | 87 | 59 | 51 | 75 | 20 |
| III/ builder | 77 | 81 | 84 | 55 | 53 | 72 | 35 |
| soap/ builder | 77 | 83 | 87 | 57 | 52 | 76 | 24 |

The above table shows that a dosage of approximately 40% of the normal dosage used for hard soaps gives similar results as regards detergency and stain removal. The foam heights also lie within the tolerable limits.

EXAMPLE V

The following table shows appearance and properties of compositions within the invention at various neutralisation degrees.

| Components | % by weight | | | | | |
|---|---|---|---|---|---|---|
| | Va | Vb | Vc | Vd | Ve | Vf |
| Nonylphenol/9 EO | 45.0 | 45.0 | 45.0 | 45.0 | 45.0 | 45.0 |
| Tall oil fatty acid | 45.0 | 45.0 | 45.0 | 45.0 | 45.0 | 45.0 |
| NaOH (50%) | 0.0 | 1.0 | 2.0 | 3.0 | 3.2 | 4.0 |
| Water | 10.0 | 9.0 | 8.0 | 7.0 | 6.8 | 6.0 |
| Degree of neutralisation in % | 0.0 | 8.1 | 16.2 | 24.3 | 25.9 | 32.5 |
| pH | 4.6 | 5.9 | 6.6 | 7.1 | 7.5 | 7.7 |
| Appearance of product | light brown homogeneous liquid-stable at 20°C | | | | | |
| Appearance and behaviour of 10% stock-solution (20°C) | stable homogeneous thin milky liquid, unaltered after 24 hours. | | | | | |

What is claimed is:

1. A liquid laundry detergent comprising 5–80% by weight of a liquid nonionic surface-active agent having a melting/pour point of up to 25°C, 95–20% by weight of a fatty acid having a melting/pour point of up to 25°C, selected from the group consisting of saturated $C_8$-$C_{22}$ fatty acids, unsaturated $C_8$-$C_{22}$ fatty acids, and mixtures thereof, said fatty acid being neutralised to a degree of 0–40% to produce a water-soluble soap, and 0–20% by weight of water, said detergent having a pH within the range of 4 to 8.

2. A liquid laundry detergent according to claim 1, in which the fatty acid present is neutralised to a degree of 5–35%.

3. A liquid laundry detergent according to claim 1, wherein the fatty acid is selected from the group, consisting of oleic acid, tall oil fatty acids and mixtures thereof.

* * * * *